United States Patent [19]

Illustrato

[11] 4,196,903

[45] Apr. 8, 1980

[54] JOG-SPRINGS

[76] Inventor: Vito J. Illustrato, 3202 Bronxwood Ave., Bronx, N.Y. 10469

[21] Appl. No.: 894,913

[22] Filed: Apr. 10, 1978

[51] Int. Cl.[2] ..... A63B 25/10

[52] U.S. Cl. ..... 272/114; 36/7.8

[58] Field of Search ..... 272/114, 134; 36/7.8

[56] References Cited

U.S. PATENT DOCUMENTS

| | | | |
|---|---|---|---|
| 1,513,338 | 10/1924 | Menefee et al. | 36/7.8 |
| 1,679,046 | 7/1928 | Menefee | 36/7.8 |
| 2,494,094 | 1/1950 | Horstman | 272/134 |

FOREIGN PATENT DOCUMENTS

| | | | |
|---|---|---|---|
| 413363 | 5/1925 | Fed. Rep. of Germany | 36/7.8 |
| 946494 | 12/1948 | France | 36/7.8 |
| 466770 | 1/1969 | Switzerland | 36/7.8 |
| 466357 | 5/1937 | United Kingdom | 36/7.8 |

*Primary Examiner*—Richard J. Apley

*Attorney, Agent, or Firm*—Richard L. Miller

[57] ABSTRACT

A pair of appliances, one of which is attachable under each foot of a person, so that the wearer can bounce vertically while walking or jogging, each appliance including a pair of vertically spaced apart platforms shaped like a foot, a plurality of compression coil springs between the platforms, and an adjustable toe strap and heel strap secured to the top platform for securement to the foot.

1 Claim, 6 Drawing Figures

JOG-SPRINGS

This invention relates generally to athletic and exercising equipment.

A principal object of the present invention is to provide a pair of jog-springs attachable under the feet of a person so as to give an upwardly and downwardly springing action to the wearer while he is walking, running or jogging.

Another object is to provide jog-springs which accordingly result in a new sensation while a person moves on his feet, which is more relaxing and which promotes the exercise of foot and leg muscles in an additional manner over conventional methods.

Yet another object is to provide jog-springs that can be made in various sizes so to accomodate men, women or children.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
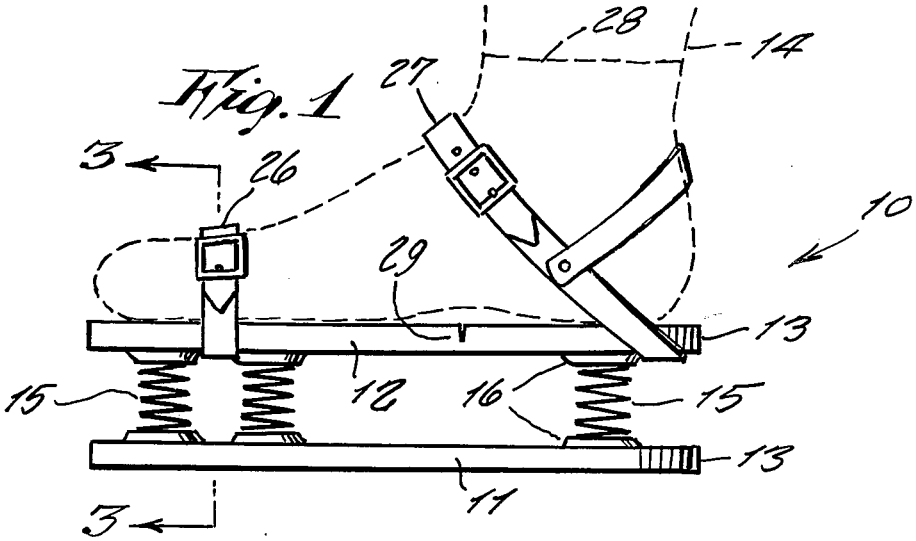
FIG. 1 is a side view of one of the jog-springs shown attached under a wearers foot.
Figure 2:
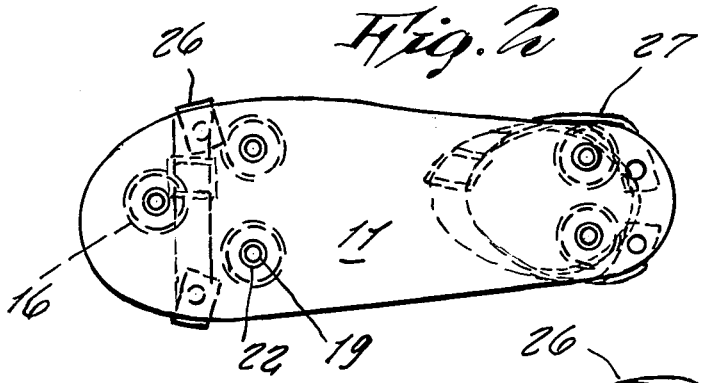
FIG. 2 is a bottom view thereof.
Figure 4:
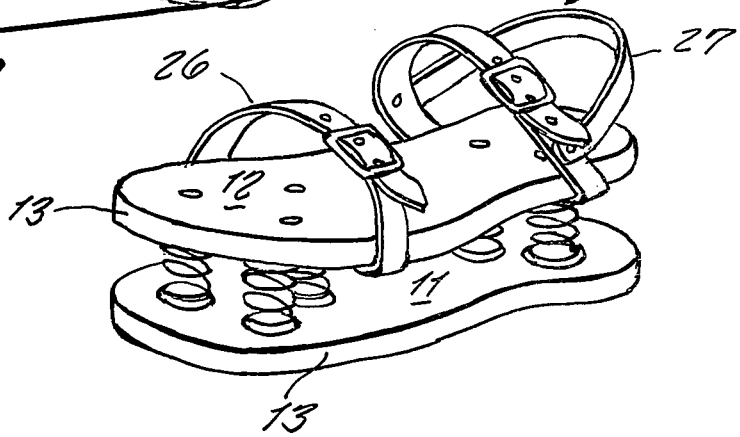
FIG. 4 is a perspective view.
Figure 3:
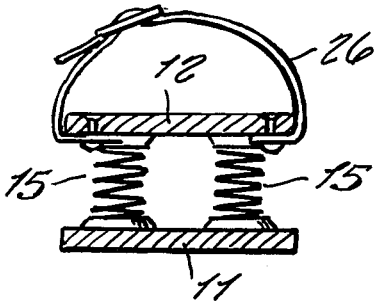
FIG. 3 is a cross sectional view on line 3—3 of FIG. 1.

Referring now to the drawing in greater detail, the reference numeral 10 represents one of a pair of jog-springs according to the present invention wherein there is a flat lower platform 11 and a flat upper platform 12 which may be made of a material such as semi-flexible rubber, plastic or the like so that they can flex slightly when in use. The platforms are a same size and have a contoured edge 13 corresponding to the shape of a persons foot 14.

Figure 5:
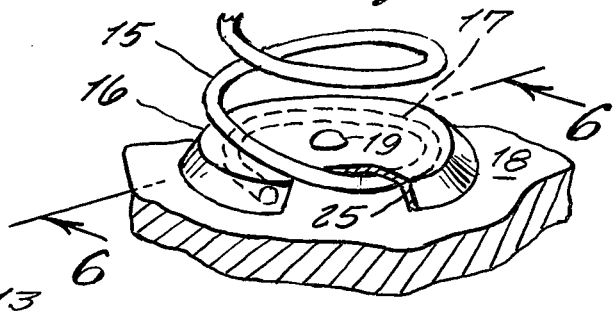
FIG. 5 is an enlarged detail of a typical spring securement to either of the platforms.
Figure 6:
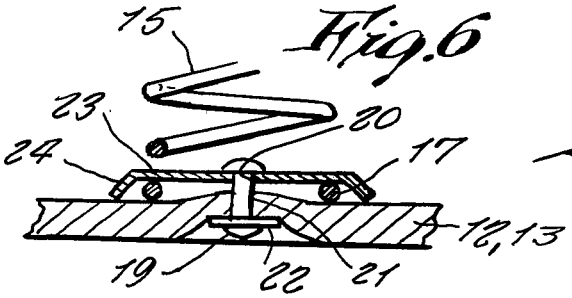
FIG. 6 is a cross sectional view on line 6—6 of FIG. 5.

The platforms are retained in parallel, spaced apart relation by means of a plurality of five compression coil springs 15 held therebetween by means of a cover plate 16 holding each endmost turn 17 of the spring against the surface 18 of the upper or lower platform and the cover plate then being rigidly secured to the platform by means of a single rivet 19 extending through a central opening 20 in the cover plate, through an opening 21 punched through the platform and through a metal washer 22, as shown in FIG. 6. The cover plate is made of a strong, non-flexing steel and includes a circular panel 23 and an angularly bent edge flange 24 that at one point has a notch 25 so to allow the spring to extend therethrough as shown in FIG. 5.

An adjustable toe strap 26 is secured across a top of a forward portion of the upper platform, and an adjustable heel strap 27 is secured across a top of a rear portion thereof.

In operative use, a wearer may preferably wear sneakers shoes 28 on his feet, and around which the jog-springs are attached.

As the person then jogs or otherwise moves, his weight upon the jog-springs causes the springs to reciprocally contract and expand so to give a soft, bouncing action that is more relaxing.

In a modified design, a transverse notch 29 on the upperside of the upper platform is located at the arch portion thereof, so to allow a greater flexibility of the platform at this point in order that it can flex upwardly into the arch of the shoe or persons foot.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A pair of jog-springs, each one of which comprises in combination, an upper and a lower platform in spaced apart relation, a plurality of compression coil springs between said platforms, and a toe strap and heel strap secured to said upper platform for attachment of said jog-spring to a foot of a wearer, said platforms being made of a semi-flexible material, said compression coil springs being secured at each opposite ends to said platforms by a dished, steel plate that encloses and holds an endmost turn of said spring against a spring surface of said platform, said plate having a peripheral notch through which said coil spring extends from behind said dished plate, and said plate being affixed to said platform by a single, central rivet, wherein a downward, transverse notch is provided on the upper side of said upper platform at the approximate location of the wearer's foot in order to provide flexing of said upper platform into the arch of the wearer's foot or shoe.

* * * * *